US005820674A

United States Patent [19]

Aidun

[11] Patent Number: 5,820,674

[45] Date of Patent: Oct. 13, 1998

[54] VORTEX-FREE COATING DEVICE FOR TRAVELING WEBS

[75] Inventor: Cyrus K. Aidun, Marietta, Ga.

[73] Assignee: Institute of Paper Science and Technology, Inc., Atlanta, Ga.

[21] Appl. No.: 699,155

[22] Filed: Aug. 16, 1996

[51] Int. Cl.[6] ..... B05C 3/02

[52] U.S. Cl. ..... 118/410; 118/419

[58] Field of Search ..... 118/410, 411, 118/419, 50; 427/434.3, 356, 348

[56] References Cited

U.S. PATENT DOCUMENTS

| | | | |
|---|---|---|---|
| 3,083,685 | 4/1963 | Colgan | 118/410 |
| 3,113,884 | 12/1963 | Kohler | 117/37 |
| 3,418,970 | 12/1968 | Phelps et al. | 118/410 |
| 3,690,917 | 9/1972 | Hershoff et al. | 117/34 |

(List continued on next page.)

OTHER PUBLICATIONS

Rudolph Beisswanger & Dr. Ing. Hans–Peter Sollinger, "Coating Paper and Board, Practical Experience with the SDTA and LDTA," from *TAPPI Seminar Notes*, 1986 Blade Coating, pp. 137–142.

E. W. Wight, "Modern Coating Application and Blade Metering Systems," from *TAPPI Seminar Notes*, 1986 Blade Coating, pp. 105–108.

Herbert Sommer, "Application Systems for Coating ULWC and MFP Papers," from *TAPPI Proceedings*, 1988 Coating Conference, pp. 131–137.

(List continued on next page.)

*Primary Examiner*—Brenda A. Lamb
*Attorney, Agent, or Firm*—Fitch, Even, Tabin & Flannery

[57] ABSTRACT

Coating devices for application of coating material to the surface of a web or a flexible substrate utilizing the study of flow patterns in blade coating to develop high-speed coaters, wherein the coater may be modified to provide an air layer between the coating liquid and any lower boundary. The coater devices of the described embodiments provide two inlet channels and an outlet channel. The first inlet channel carries the coating liquid, and the second channel can be used to pump the carrier fluid, e.g. air, into the coating head to pressurize the chamber and to keep the contact wetting line at the upstream section attached to the substrate. The air layer serves as a carrier fluid removing the wall shear stress on the coating liquid in the channel, and thus the coating flow for the operation of the device may proceed without flow separation from the wall (i.e., in a vortex-free mode) at relatively low flow rates appropriate for commercial applications. The excess coating liquid and all of the air leave the coater head at the outlet channel. A coating composition application chamber receives the liquid flow of the liquid coating composition from the upstream direction to the downstream direction. The coating composition application chamber is adapted for receiving a liquid flow of a carrier fluid introduced at the upstream side of the application chamber in the direction of the travel of the web positioning the liquid flow of the liquid coating composition between the carrier fluid and the web.

15 Claims, 13 Drawing Sheets

U.S. PATENT DOCUMENTS

| | | | |
|---|---|---|---|
| 4,102,299 | 7/1978 | Wallstén | 118/50 |
| 4,250,211 | 2/1981 | Damrau et al. | 427/356 |
| 4,369,731 | 1/1983 | Damrau | 118/410 |
| 4,387,663 | 6/1983 | Alheid | 118/413 |
| 4,452,833 | 6/1984 | Holt | 427/356 |
| 4,643,127 | 2/1987 | Wanke | 118/413 |
| 4,688,516 | 8/1987 | Sommer | 118/410 |
| 4,834,018 | 5/1989 | Sollinger et al. | 118/410 |
| 4,836,134 | 6/1989 | Knop | 118/413 |
| 4,839,201 | 6/1989 | Rantanen et al. | 427/355 |
| 4,858,553 | 8/1989 | Westergard et al. | 118/126 |
| 4,873,939 | 10/1989 | Eskelinen | 118/410 |
| 4,880,671 | 11/1989 | Sollinger et al. | 118/410 |
| 4,920,913 | 5/1990 | Knop et al. | 118/410 |
| 4,945,855 | 8/1990 | Eklund et al. | 118/407 |
| 5,173,120 | 12/1992 | Suzummura et al. | 118/410 |
| 5,354,376 | 10/1994 | Aidun | 118/410 |
| 5,366,551 | 11/1994 | Aidun | 118/411 |

OTHER PUBLICATIONS

F. R. Pranckh & L. E. Scriven, "Elastohydrodynamics of Blade Coating," *AIChE Journal*, vol. 36, No. 4, pp. 587–597, Apr. 1990. (Best Copy).

N.G. Triantafillopoulos & C. K. Aidun, "Relationship Between Flow Instability in Short–Dwell Ponds and Cross Directional Coat Weight Nonuniformities," reprinted from *TAPPI Journal*, vol. 73, No. 6, pp. 127–136, Jun., 1990.

Cyrus K. Aidun, "Principles of Hydrodynamic Instability: Application on Coating Systems; Part 1. Background," reprinted from *TAPPI Journal*, vol. 74, No. 2, pp. 213–219, Feb., 1991.

Cyrus K. Aidun, "Principles of Hydrodynamic Instability: Application on Coating Systems; Part 2. Examples of Flow Instability," reprinted from *TAPPI Journal*, vol. 74, No. 3, pp. 213–220, Mar., 1991.

Cyrus K. Aidun, "Principles of Hydrodynamic Instanbility: Application on Coating Systems; Part 3. A Generalized View of Instability and Bifurcation," reprinted from *TAPPI Journal*, vol. 74, No. 4, pp. 209–213, Apr., 1991.

Cyrus K. Aidun, N. G. Triantafillopoulos and J. D. Benson, "Global Stability of a Lid–Driven Cavity With Throughflow: Flow Visualization Studies," from *Phys. Fluids A*, vol. 3, No. 9, American Institute of Physics, pp. 2081–2091, Sep., 1991.

J. D. Benson and C. K. Aidun, "Transition to Unsteady Nonperiodic State in a Through–Flow Lid–Driven Cavity," from *Phys. Fluids A*, (Brief Communications) vol. 4, No. 10, American Institute of Physics, pp. 2316–2319, Oct., 1992.

C5V20
UX
1 00000
0 80000
0 60000
0 40000
0 20000
0 00000
0 00000 0 80000 0 16000
0 40000 0 12000 0 20000
COORDINATE (X10-1)

C5V20
UX
1 00000
0 80000
0 60000
0 40000
0 20000
0 00000
0 00000 0 80000 0 16000
0 40000 0 12000 0 20000
COORDINATE (X10-1)

C5V20
UX
1 00000
0 99744
0 99487
0 99231
0 98974
0 98718
0 00000 0 04412 0 08824
0 2206 0 06618 0 11030
COORDINATE (X10-1)

C5V20
PRES
1 12145
0 89556
0 66966
0 44377
0 21788
00801
0 00000 0 96167 1 92333
0 48083 1 44250 2 48416
COORDINATE (X10+1)

C5V20
PRES
1 00273
0 78526
0 56778
0 35031
0 13284
-0 08463
0 00000 0 95281 1 90562
0 47641 1 42922 2 38203
COORDINATE (X10+1)

C5V20
PRES
1 02093
0 78386
0 54678
0 30970
0 07262
-0 16446
0 00000 0 20000 0 40000
0 10000 0 30000 0 50000
COORDINATE

VORTEX-FREE COATING DEVICE FOR TRAVELING WEBS

FIELD OF THE INVENTION

The present invention relates generally to a coating device for uniform coating of a traveling web of material. More particularly, the present invention relates to a pressurized coater which eliminates the captive pond associated with pressurized pond coaters, and provides the coating material in the form of a flowing stream of liquid coating composition which flows in the same direction as the web movement in a vortex-free coater reducing wall shear stress on the coating material.

BACKGROUND OF THE INVENTION

One of the most significant changes in light weight coated (LWC) paper production is the use of the pressurized pond coater. The pressurized pond coater such as short-dwell coaters has enabled the paper maker to improve productivity while maintaining coated paper quality. The term "short-dwell" refers to the relatively short period of time that the coating is in contact with a web of paper material before the excess is metered off by a trailing doctor blade. Prior art short-dwell coaters consist of a captive pond just prior to a doctor blade. The pond is approximately 5 cm in length and is slightly pressurized to promote adhesion of the coating to the paper web. The excess coating supplied to the sheet creates a backflow of coating. This coating backflow provides a wetting line and thus, to some extent, excludes the boundary layer of air entering with the sheet and eliminates skip coating. The excess coating is typically channeled over an overflow baffle and collected in a return pan before returning to tanks to be screened.

While pond coaters are extensively used in coating paper webs, such coaters suffer from a major problem. The flow in the coating chamber of the pond upstream of the doctor blade contains recirculating eddies or vortices which can result in coat-weight nonuniformities and wet streaks or striations in several ways. For example, these eddies can become unstable due to centrifugal forces and result in the generation of unsteady flow and rapidly fluctuating vortices, which deteriorate the coating uniformity and its quality. Also, the vortices tend to entrap small air bubbles which result in the buildup of relatively large air inclusions in the coating liquid which tend to accumulate in the core region of the eddies. Vortex fluctuations tend to force these air inclusions into the blade gap. This adversely affects the coating quality. Usually, the presence of air inclusions results in regions of lower coat weight which are 2–4 cm wide and about 10–100 cm long, known in the industry as "wet streaks". These problems are discussed in an article "Principles of Hydrodynamic Instability: Application in Coating Systems", C. K. Aidun, Tappi Journal, Vol. 74, No. 3, March, 1991.

Previously, geometries utilizing streamlined boundaries in coating devices have been employed to eliminate the formation of recirculating eddies or vortices. See, e.g., Aidun, U.S. Pat. No. 5,366,551 entitled "Coating Device for Traveling Webs," wherein curvilinear geometries are employed for the elimination of vortices and flow instability due to centrifugal forces, and for the avoidance of harmful pressure fluctuations which could result in coat-weight nonuniformities. The elimination of recirculating eddies or vortices also reduces the possibility of entrapping air pockets or air bubbles in the core of the vortices which could reach the blade gap and could result in coat-weight nonuniformities and wet streaks.

Additionally, the walls of the coating composition application chamber in conventional coating devices are considered rigid and do not deform under the effect of hydrodynamic pressure, and thus exert shear stress by the flow on the boundaries in contact with the coating liquid. Such wall shear stress on the coating liquid creates flow separation from the applicator walls in the application chamber which also results in coat-weight nonuniformities and wet streaks, as well as, recirculating eddies and vortices. Pranckh, F. R., and Scriven, L. E., "The Physics of Blade Coating of Deformable Substrate," 1988 Coating Conference Proc., TAPPI Press, Atlanta, Ga., (1988) have provided a detailed analysis of blade coating using a finite element approximation method including the complex interactions of the boundary in addition to the solution of the flow field and free surface location. The blade was modeled as a thin, inextensible, elastic solid and the substrate deformed due to normal stresses. In Aidun, U.S. Pat. No. 5,354,376 entitled "Floatation Coating Device for Traveling Webs," one of the applicator walls is designed to be a floating or moving wall or belt. The effect of the floating applicator wall is to reduce vortices through the use of a moving substrate, e.g. a suspended belt, as the applicator wall which moves with a given speed with the liquid to prevent flow separation and recirculation inside the application chamber. The floatation coating device for traveling webs seeks to alleviate recirculations in a fixed domain pressurized pond coating system. The combination of a moving applicator wall and a sufficient flowrate allow for the design of a vortex-free coater configuration.

Development of high speed blade coating is of particular interest in the industry to enhance production, and to reduce cost the analysis of the coating process which is complex because the governing equations of fluid motion are nonlinear and the free-surface position is part of the unknown. Moreover, the non-linear constitutive behavior of typical coating fluids increases the complexity.

It would be desirable to provide a coating device which has the coating advantages of a short-dwell coater, but which did not have the problems associated with recirculating eddies or vortices and the entrapment of air pockets or air bubbles in the core of the vortices.

It would be further desirable to provide a coating device with reduced shear stress on the flowing stream of the liquid coating composition in the application chamber as the coating composition downstreams.

It is another object of the present invention to provide a coating device which receives a liquid flow of a carrier fluid introduced in the direction of the travel of the web positioning the liquid flow of the liquid coating composition between the carrier fluid and the web with reduced shear stress on the flowing stream of the liquid coating composition in the application chamber as the coating composition downstreams.

It is a further object of the present invention to provide a coating device which receives the flow of carrier fluid through a channel for directing air flow into the coating composition application chamber below the flow of the liquid coating composition reducing shear stress on the flowing stream of the liquid coating composition.

Accordingly, it is a principal object of the present invention to provide a vortex-free short-dwell coating device.

These and other objects will become more apparent from the following description and the appended claims.

SUMMARY OF THE INVENTION

The invention relates to coating devices for application of coating material to the surface of a web or a flexible substrate. Such coating devices employ a pressurized channel where a flowing stream of the coating liquid comes into contact with the substrate. The coating liquid first enters at the upstream side of the channel wetting the substrate as it flows in the same direction with the substrate. A doctor element is positioned at the downstream side of the channel where the excess coating in the channel follows the contour of the boundary formed by the doctor element and leaves the channel.

The present invention is further directed toward the study of flow patterns in blade coating to develop high-speed coaters, wherein the coater may be modified to provide an air layer between the coating liquid and any lower boundary. The air layer thus serves as a carrier fluid.

The coater devices of the described embodiments provide two inlet channels and an outlet channel. The first inlet channel carries the coating liquid, and the second channel can be used to pump the carrier fluid, e.g. air, into the coating head to pressurize the chamber and to keep the contact wetting line at the upstream section attached to the substrate. The air pressure can vary from zero to any level appropriate for the coating operation. The air layer serves as a carrier fluid removing the wall shear stress on the coating liquid in the channel, and thus the coating flow for the operation of the device may proceed without flow separation from the wall (i.e., in a vortex-free mode) at relatively low flow rates appropriate for commercial applications. The excess coating liquid and all of the air leave the coater head at the outlet channel. The blade is used to meter the excess coating from the substrate.

Accordingly the pressure inside the channel may be increased above ambient pressure, if necessary, in order to prevent air entrainment into the coating liquid. However, the system may also operate at ambient pressure if air entrainment is not an issue. The revised vortex-free coater and computation simulation of the flow in the system are presented below. The computation simulations assume ambient pressure in the air layer and, therefore, consider the coating layer just upstream of the blade.

Briefly summarized, the present invention relates to high speed coating methods and apparatus for applying a liquid coating composition on a web of material as the web travels along a path through the device from an upstream direction to a downstream direction with a doctor element being spaced from the web and extending across the path of the web transversely of the direction of travel of the web. A coating composition application chamber receives the liquid flow of the liquid coating composition from the upstream direction to the downstream direction, and comprises an upstream interior side wall and an upstream boundary wall for directing the liquid coating composition flow into the application chamber, and the doctor element for spreading and defining the thickness of the liquid coating composition on the web at the downstream side of the application chamber. The coating composition application chamber is further adapted for receiving a liquid flow of a carrier fluid introduced at the upstream side of the application chamber in the direction of the travel of the web positioning the liquid flow of the liquid coating composition between the carrier fluid and the web, the liquid coating composition flowing from the upstream side of the application chamber in the direction of the travel of the web to the doctor element defining a path which the flowing stream of the liquid coating composition downstreams in the direction of travel of the web with reduced shear stress on the flowing stream of the liquid coating composition in the application chamber as the coating composition downstreams.

DETAILED DESCRIPTION OF THE EMBODIMENTS

Figure 1A:
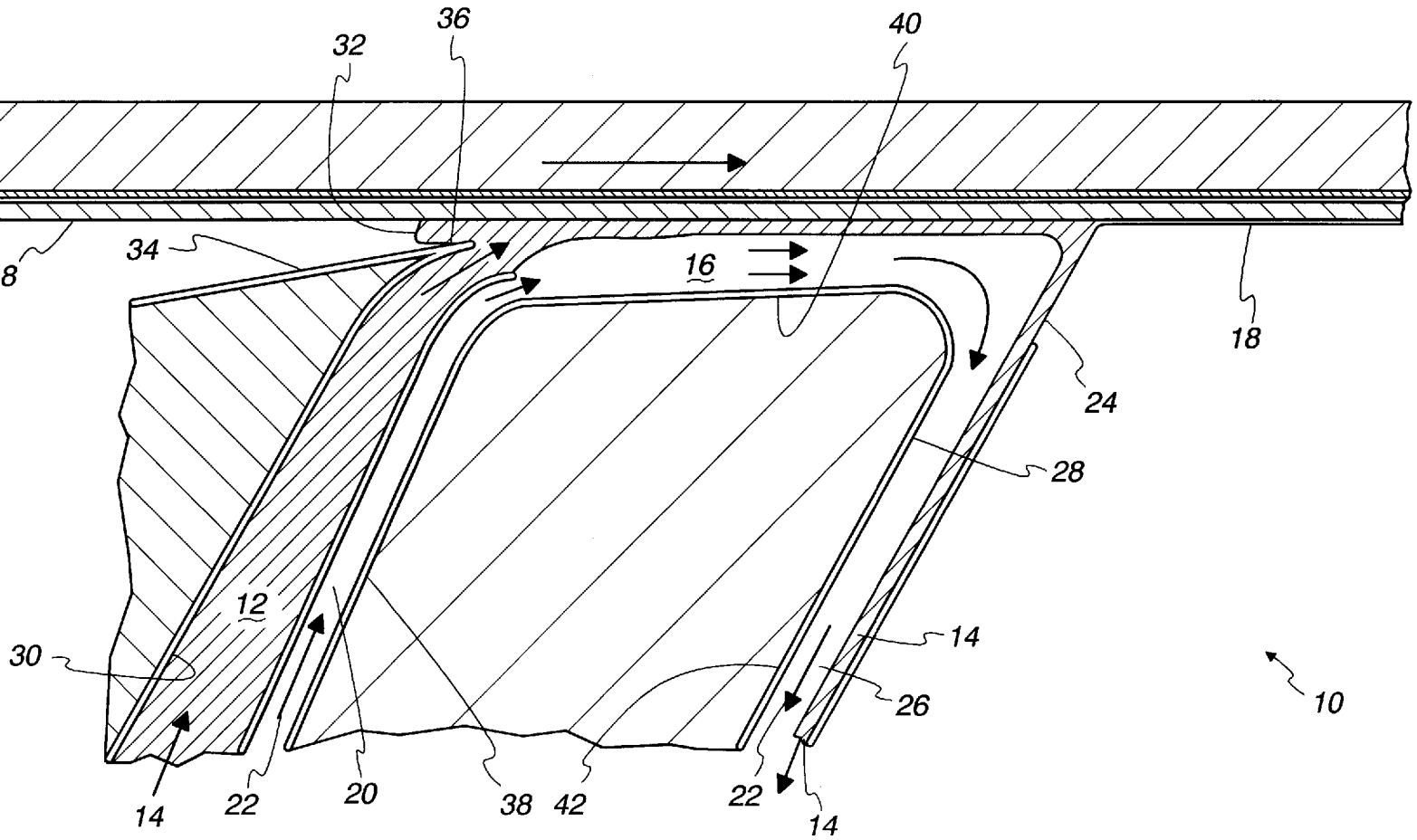
FIG. 1 is a schematic cross-sectional view of an embodiment of a short-dwell coating device according to the invention.
FIG. 1B is a schematic cross-sectional view of another embodiment of the short-dwell coating device according to the invention.
FIG. 1C represents a domain description in cross-section for the described studies of the short-dwell coating devices according to the invention.

As shown in FIG. 1A, the short-dwell coating device 10 of the present invention includes of a first continuous channel 12 for receiving a liquid coating composition material 14 which passes through a coating application chamber 16 which is in contact with a roll or web 18 of material which is to be coated. The coating device 10 further includes of a second continuous channel 20 for receiving a liquid flow of a carrier fluid such as air 22 which also passes through a coating application chamber 16 positioning the liquid flow of the liquid coating composition 14 between the carrier fluid 22 and the web 18 of material which is to be coated. For purposes of orientation and discussion, the coating chamber has an upstream side and a downstream side with respect to movement of the web with the upstream side being to the left of FIG. 1A. The use of the terms "horizontal" and "vertical" are with respect to a horizontal orientation of the web 18. The web 18, however, is usually supported on a counter roll and has a slight curvature in the region of the coating application chamber 16.

The coating devices described herein include a blade or doctor element 24 which is spaced from the web 18 for defining the thickness of the coating on the web 18. The doctor element 24 extends across the 18 web transversely to the direction of the web motion. The doctor element also forms a downstream boundary wall of the coating chamber 16 and extends downwardly for a further distance to define the downstream wall of an exit plenum or outlet channel 26 formed between the doctor element 24 and a downstream interior wall 28 in the embodiment of FIG. 1A, for the circulation of the liquid flow of the carrier fluid, e.g., air 22 which circulates with the liquid flow of the liquid coating composition 14 through the coating application chamber 16 as the web 18 of material which is coated.

In FIG. 1A, an upstream boundary wall 30 defines the upstream side of the coating device 10. The upstream boundary wall 30 extends downwardly for a further distance to define the upstream side of an entrance plenum of the first channel 12. The upstream boundary wall 30 terminates at its uppermost end in contact with the web 18 via a contact line or wetting line 32 of the liquid coating composition 14, thus preventing air entrainment at the upstream section 34. As shown, the terminal end 36 of the upstream boundary wall 30 preferably has a curvilinear shape so that this terminus of the upstream boundary wall is substantially tangential to the web 18. The upstream boundary wall 30 and its terminal end 36 also extend across the web transversely to the direction of the web motion.

The coating device 10 and particularly the coating application chamber 16 are represented in cross-section in FIG. 1A. The embodiment of FIG. 1A provides interior walls including an upstream interior side wall 38, an interior top wall 40 and an downstream interior side wall 42. The interior walls 38, 40 and 42 in combination with the upstream boundary wall 30 and the doctor element 24 define the coating composition application chamber 16 of the embodiment. The coating composition application chamber 16 is further adapted for receiving the liquid flow of the carrier fluid 22 as a fluid layer introduced from the upstream side of the application chamber substantially parallel to and in the direction of the travel of the web supporting the liquid flow of the liquid coating composition 14 between the fluid layer 22 and the web 18.

The fluid layer opposite the web defines a top interior fluid layer wall above the interior top wall 40 and the fluid layer opposite the doctor blade defining a downstream interior fluid layer wall adjacent the downstream interior side wall 42. The top interior fluid layer wall of the carrier fluid 22 provide a layer which substantially conveys the liquid coating composition 14 from the terminating curvilinear section of the upstream interior wall in the direction of the travel of the web to the doctor element 24. The coating device 10 also provides the upstream boundary wall 30 and the upstream interior side wall 38 as upwardly inclined in a direction toward the downstream side; the downstream interior wall 42 and the doctor element 24 being downwardly inclined in a direction toward or away from the upstream side. Accordingly, the upstream walls 30, 38, the top interior fluid layer wall and web 18, the downstream interior fluid layer wall and doctor element 24 thus define a path in which the flowing stream of the liquid coating composition 14 downstreams in the direction of travel of the web 18 to at least reduce wall shear stress on the flowing stream of the liquid coating composition from the interior fluid layer wall as the coating composition downstreams thereon, reducing the formation of recirculating eddies and vortices in the coating composition.

Figure 1B:
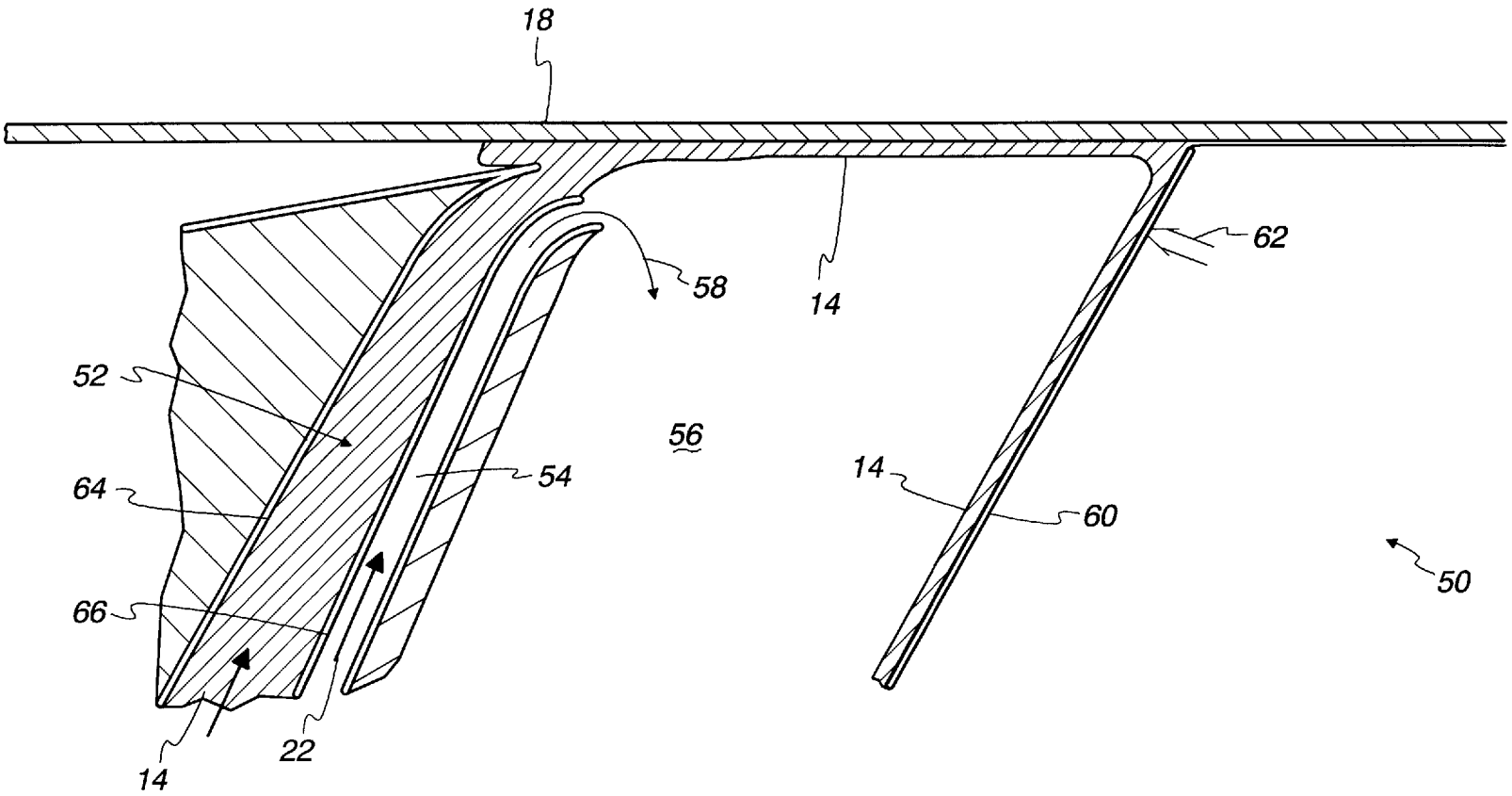

FIG. 1B shows an another embodiment of a short-dwell coating device 50 of the present invention which includes of a first continuous channel 52 for receiving the liquid coating composition material 14 which passes through a coating application chamber 56 in contact with the web 18 to be coated. The coating device 50 also includes of a second continuous channel 54 for receiving a liquid flow of the carrier fluid, e.g., air 22 which also passes through the coating application chamber 56 positioning the liquid flow of the liquid coating composition 14 between the carrier fluid 22 and the web 18 of material which is to be coated, as in the embodiment of FIG. 1A discussed above. The FIG. 1B embodiment however does not utilize the interior top wall 40 and downstream interior side wall 42 of FIG. 1A, and thus allows the carrier fluid 22 to exit into the open area of the coating application chamber 56, which may be provided under pressure. At an upstream opening 58 of the second continuous channel 54, the liquid coating composition material 14 is pressed as a layer against the web 18. The flow rate of the liquid coating composition material 14 is reduced in the FIG. 1B embodiment, with respect to the FIG. 1A embodiment, and an approximately 1 mm. thick layer the liquid coating composition material 14 adhering to the web 18 travels the 5 to 10 centimeters in the coating application chamber 56 to a doctor element 60 biased with a load 62 to spread and define the thickness of the liquid coating composition 14 on the web 18. As in the FIG. 1A embodiment, the doctor element 60 also extends across the path of the web 18 transversely of the direction of travel of the web 18.

Pressure provided at the upstream opening 58 of the second continuous channel 54 is desirable where the liquid coating composition material 14 is layered against the web 18 to prevent air entrainment by maintaining the contact or wetting line of the liquid coating composition 14 with the web 18, as discussed above. Advantageously however, any pressure provided in the coating application chamber 56 of the FIG. 1B embodiment is reduced downstream of the opening 58, and thus the likelihood of downstream entrainment by the carrier fluid itself is reduced.

The coating device 50 and particularly the coating application chamber 56 are represented in cross-section in FIG. 1B. The embodiment of FIG. 1B provides an upstream interior side wall 64 and an upstream boundary wall 66 for directing the liquid coating composition flow into the application chamber 56. The coating composition application chamber 56 also is adapted for receiving the liquid flow of the carrier fluid 22 introduced at the upstream side of the application chamber 56 in the direction of the travel of the web 18 positioning the liquid flow of the liquid coating composition 14 between the carrier fluid 22 and the web 18.

The liquid coating composition 14 thus flow from the upstream side of the application chamber in the direction of the travel of the web 18 to the doctor element 60 defining a path which the flowing stream of the liquid coating composition downstreams in the direction of travel of the web with reduced shear stress on the flowing stream of the liquid coating composition in the application chamber as the coating composition downstreams.

The embodiments described concern the study of modified vortex-free coater configurations in an effort to investigate the hydrodynamic behavior of the current system at very low flow rates. Avoidance of flow separation and recirculation is shown in studies by way of computer modelling. The flow field and the free surface boundary location are solved using a Galerkin finite element approach for web speeds ranging from 15 m/s to 30 m/s and flow rates from 4 to 7 liter/sec./mete (1/s/m). Several mechanisms of instability are present due to the complexity of the domain in coating devices. The non-linear constitutive behavior of typical coating fluids increases the complexity. Boundaries within such high speed coating devices are typically flexible, permeable, and unknown in different regions. Accordingly, the flow is modeled as being nearly parallel throughout the majority of the domain, with the important exception of the region in which the web and the blade converge forcing some of the liquid under the blade tip and the rest to curve and flow down the blade.

Figure 1C:
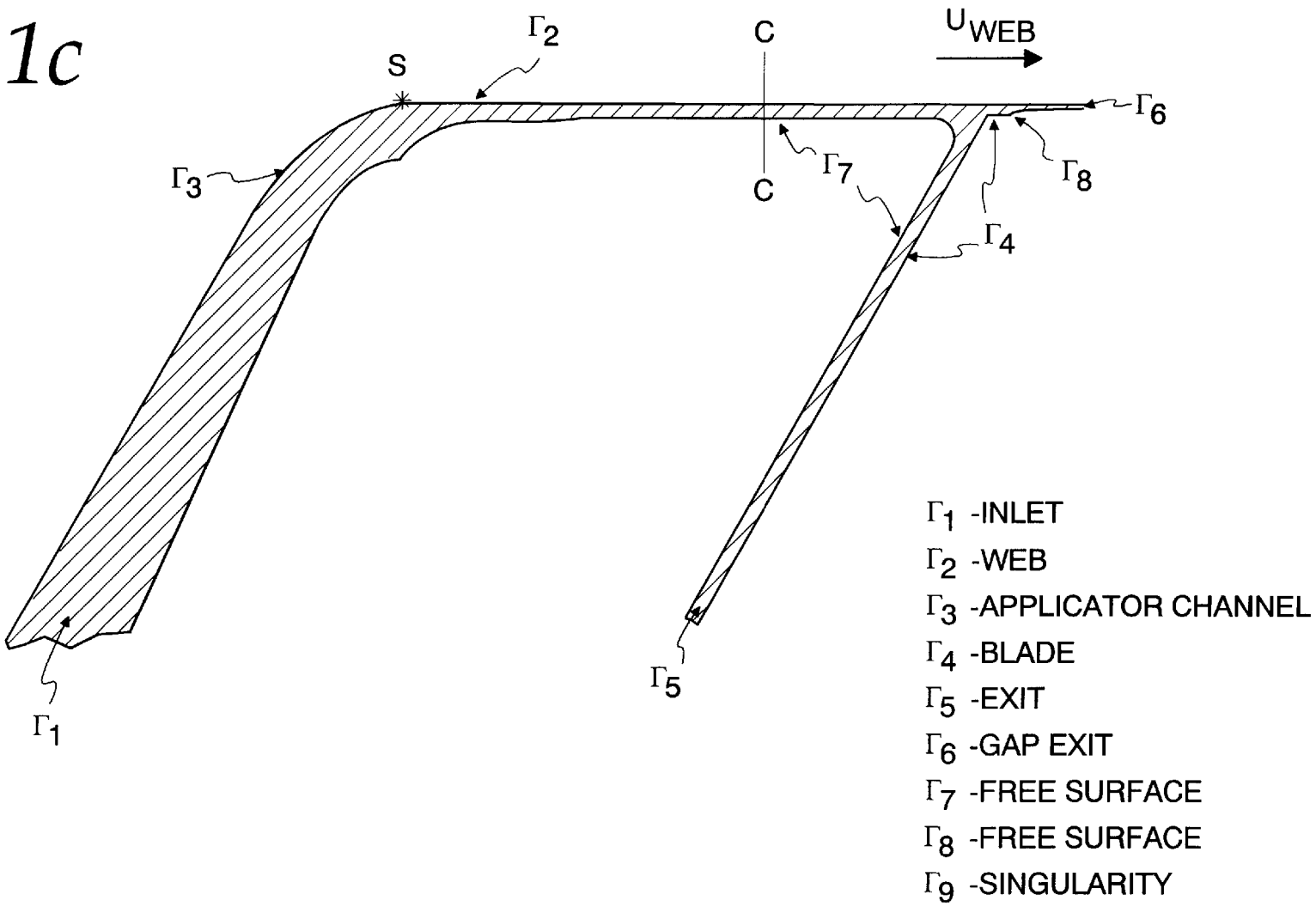
Figure 2:
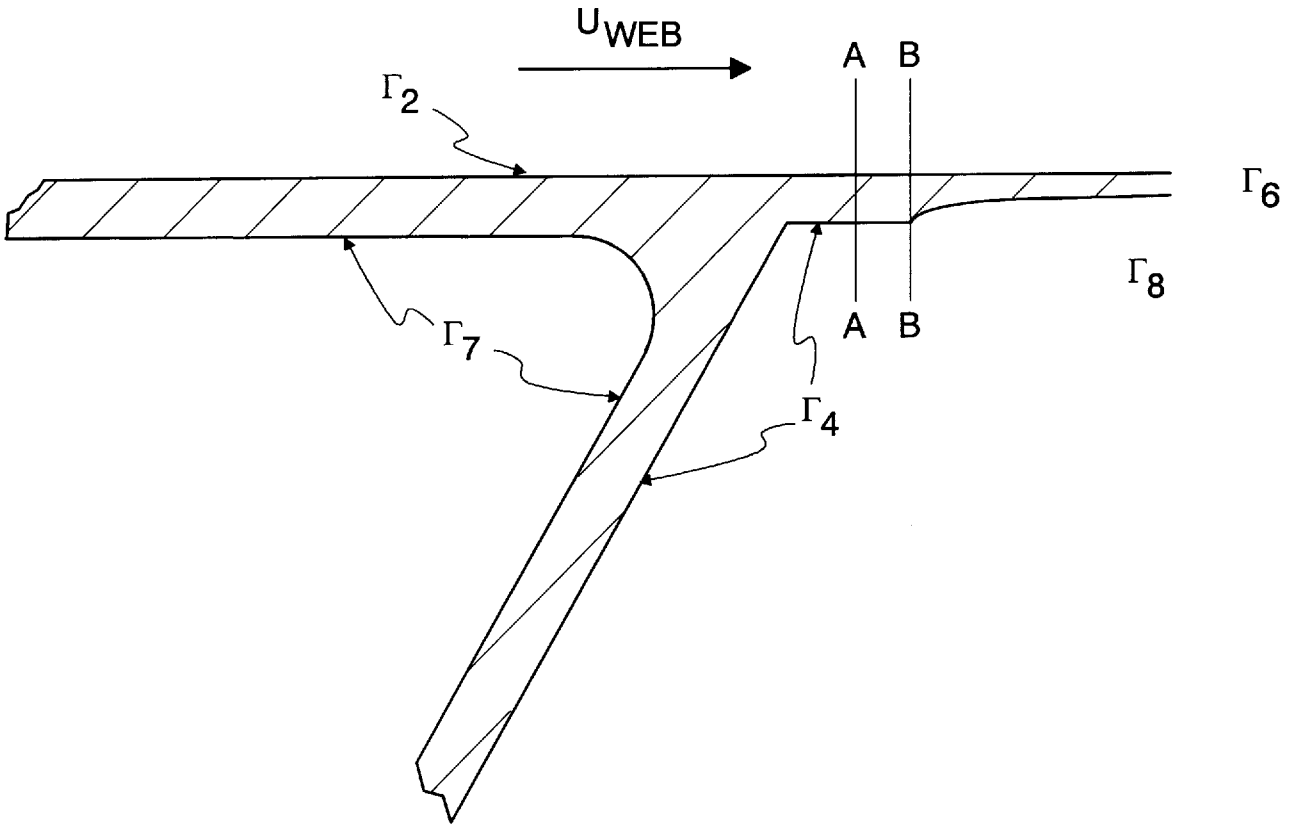
FIG. 2 represents a gap region description of the domain for short-dwell coating devices.

In the gap region, between the substrate and the blade tip, the flow is nearly parallel and experiences high shear rates. Squires theorem requires that the first instability in parallel shear flows occur due to a two-dimensional instability. In the returning flow, the possibility of centrifugal instabilities to three-dimensional disturbances exist. The flow field of a blade coater with a lower free surface is examined. The flow is assumed to be incompressible, two-dimensional and steady. The effects of flowrate and web speed variation on the design will provide insight into the optimal operating conditions. A further analysis of the stability of the resulting solutions to 2-D and 3-D disturbances will provide additional information. The velocity field, pressure field, and location of the two free surfaces of the blade coater is depicted in FIG. 1C with parameters detailed in Tables 1 and 2. The region of particular interest is shown in FIG. 2, here the blade ($G_4$) and the web ($G_2$), converge to form a gap with a vertical cross-section length (blade gap) of 50 microns. A portion of the fluid pumped in at the inlet ($G_1$) proceeds through the gap and coats the substrate, while the excess is scraped off and flows nearly parallel to the blade.

TABLE 1

| Fluid Parameters | | | |
|---|---|---|---|
| $\rho$ | density | 1200 | kg/m$^3$ |
| $\mu_o$ | zero shear rate viscosity | 1.0 | kg/(m-s) |
| $\mu_\infty$ | infinite shear rate viscosity | 0.05 | kg/(m-s) |
| $\gamma$ | surface tension | 0.05 | kg/s$^2$ |
| c | Carreau exponent | 0.65 | |
| K | time constant | 0.01 | s |
| $U_{web}$ | web velocity | varies from 15–30 | m/s |
| $U_{inlet}$ | centerline velocity on inlet | varies from 2–5 | m/s |
| $q_{inlet}$ | inlet flowrate | varies from 4–7 | l/s/m |

TABLE 2

| Geometry Parameters | | | |
|---|---|---|---|
| $L_{inlet}$ | inlet length | 0.0025 | m |
| $L_{gap}$ | gap length | 50 E-6 | m |
| $L_{ace}$ | applicator channel exit | 0.5 | mm |
| $L_{thick}$ | blade thickness | 1.25 | mm |
| $L_{blade}$ | blade length (modeled) | 60.104 | mm |
| $L_{web}$ | web length (modeled) | 59.551 | mm |
| $<_{blade}$ | angle of blade | 45° | |
| $C_t$ | coating thickness | O(10 | $\mu$m) |
| $W_t$ | vertical distance from web to free surface at C—C | O(100 | $\mu$m) |

The problem can be defined in a dimensionless manner. The inlet cross-section length and web velocity are used as the length and velocity scales. Table 3 relates the dimensionless quantities to the parameters given in Tables 1 and 2.

TABLE 3

| Dimensionless Quantities | | |
|---|---|---|
| Re | Reynolds Number | $\mathrm{Re} = \frac{\rho U_{web} L_{in}}{\mu}$ |
| Ca | Capillary Number | $\mathrm{Ca} = \frac{\mu U_{web}}{\gamma}$ |
| We | Weber Number | $\mathrm{We} = \frac{1}{\mathrm{ReCa}} = \frac{\gamma}{\rho U_{web}^2 L_{in}}$ |

The equations governing the flow in the coater are continuity and momentum $$\nabla \cdot \vec{v} = u_{i,j} = 0 \tag{1}$$

$$\rho \left[ \frac{\partial u_i}{\partial t} + u_j u_{i,j} \right] = \sigma_{ij,j} + \rho f_i \tag{2}$$

Here $\sigma_{ij}$ denotes the stress tensor, is assumed to be of the form $$\sigma_{ij} = -p\delta_{ij} + \tau_{ij}$$

Where $\tau_{ij}$ denotes the deviatoric stress tensor with the constitutive relation $$\tau_{ij} = 2\mu\epsilon_{ij}$$

Where $\epsilon_{ij}$ is the rate of strain tensor, given by $$\epsilon_{ij} = \frac{1}{2}(u_{i,j} + u_{j,i})$$

The fluid for the current application is assumed to be shear thinning, the dynamic viscosity is approximated by the Carreau constitutive model $$\mu = \mu_\infty + (\mu_o - \mu_\infty)[1 + K^2 \epsilon_{ij}\epsilon_{ij}]^{(n-1)/2} \tag{3}$$

where $\mu_o$ and $\mu_\infty$ denote the zero and infinite shear rate viscosities. The parameters in the Carreau model are determined based on the behavior of typical coating colors.

The above equations are non-dimensionalized using the velocity of the web and the width of the inlet channel as the velocity and length scales respectively $$U_s = U_{web},\ L_s = L_{inlet}$$

The velocity and pressure are scaled using the velocity and dynamic pressure scales $$u_i^* = \frac{u_i}{U_s}, \quad p^* = \frac{p}{\rho U_s^2}$$

The superscript * denotes dimensionless variable. The independent variables, position and time, are scaled using the velocity and length scales $$x_i^* = \frac{x_i}{L_s}, \quad t^* = t\frac{U_s}{L_s}$$

The body force $f_i$ is non-dimensionalized $$f_i^* = f_i\frac{L_s}{U_s^2}$$

The continuity, momentum, and constitutive relations can respectively be expressed in dimensionless form as $$u_{i,j^*}^* = 0, \tag{4}$$

$$\left[\frac{\partial u_i^*}{\partial t^*} + u_j^* u_{i,j^*}^*\right] = \sigma_{ij,j^*}^* + f_i^*, \tag{5}$$

and $$\frac{1}{Re} = \frac{1}{Re_\infty} + \left(\frac{1}{Re_o} - \frac{1}{Re_\infty}\right)[1 + K^{*2}\epsilon_{ij}^*\epsilon_{ij}^*]^{(c-1)/2} \tag{6}$$

where $$\sigma_{ij}^* = -p^*\delta_{ij} + \tau_{ij}^*$$

$$\tau_{ij}^* = 2\epsilon_{ij}^*\frac{\mu}{\rho U_s L_s} = 2\epsilon_{ij}^*\frac{1}{Re}$$

$$\epsilon_{ij}^* = \frac{1}{2}(u_{i,j}^* + u_{j,i}^*)$$

$$K^* = K\frac{U_s}{L_s}$$

The Dirichlet boundary conditions for this coating system are specified as $$u_i^*|_{\Gamma_1} = \frac{U_{inlet}}{U_s}, \quad \Gamma_1 \Rightarrow \text{inlet}$$

$$u_i^*|_{\Gamma_2} = \frac{U_{web}}{U_s} = 1 \quad \Gamma_2 \Rightarrow \text{web}$$

$$u_i^*|_{\Gamma_3} = u_i^*|_{\Gamma_3} = 0 \quad \Gamma_3 \Rightarrow \text{applicator channel},$$

$$\Gamma_4 \Rightarrow \text{blade}$$

Neumann conditions are applied at the outflow boundaries $$\sigma_n^*|_{\Gamma_5} = \sigma_n^*|_{\Gamma_6} = 0 \quad \Gamma_5 \Rightarrow \text{exit}, \ \Gamma_6 \Rightarrow \text{gap exit}$$

On the free surfaces ($\Gamma_7$ and $\Gamma_8$) the kinematic condition is given by $$\frac{d\eta^*}{dt^*} = \frac{\partial\eta^*}{\partial t^*} + \frac{\partial\eta^*}{\partial x_i^*}u_i^*$$

When the flow is independent of time this condition reduces to $$\mu_i^* n_i = 0 \tag{7}$$

where $n_i$ is the unit vector normal to the surface.

The dynamic boundary condition requires the stress to be continuous across the interface, therefore the normal and tangential stresses are respectively given by $$\sigma_n = 2\gamma H - p_a$$

$$\sigma_t = \hat{t}_i\frac{\partial\gamma}{\partial x_i}$$

The fluid surface tension, $\gamma$, is constant, therefore the tangential component of the traction vector is zero. The above dynamic boundary condition is non-dimensionalized by $$\sigma_n^* = \frac{2H^*}{ReCa} - p_a^* = \frac{2H^*}{We} - p_a^*$$

$$\sigma_t^* = 0$$

The above non-dimensional equations (4) and (5) with the constitutive relation (6) and appropriate boundary conditions completely describe the flow field. The finite element method is employed via FIDAP to solve for the velocity and pressure at discrete points within the domain. The unknown boundary location is determined in a fully coupled manner by simultaneously requiring the condition (7) be satisfied on the free surfaces.

The governing equations, constitutive relation, and boundary conditions completely define the given blade coating problem. The domain is discretized using 9-noded, isoparametric, quadrilateral elements. The velocity is approximated over the element using biquadtratic basis functions and the pressure with bilinear basis functions. The free surface boundary is determined by satisfying the steady state kinematic and dynamic conditions in a fully coupled manner.

The nonlinearity of the governing equations requires an iterative solution approach. The stokes flow in the fixed domain provides an initial guess for the Newton-Raphson iteration procedure. Parameter continuation methods are used to assist in the variation of the parameters to reach the desired solution for given boundary conditions. Convergence is achieved when the norm of the solution change in between iterations is less than $10^{-3}$.

Figure 3:
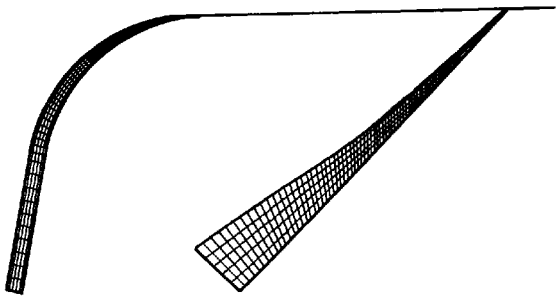
FIG. 3 illustrates the effect of flowrate variation shown as a mesh drawing representation of the domain.
Figure 4:
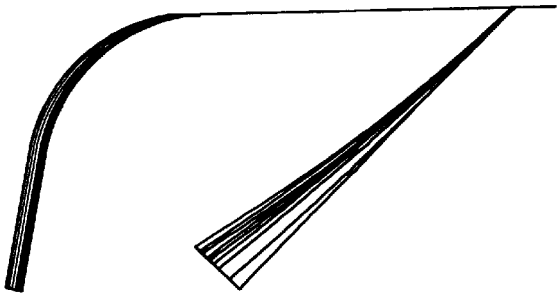
FIG. 4 illustrates the effect of flowrate variation shown as streamlines in the domain.
Figure 5:
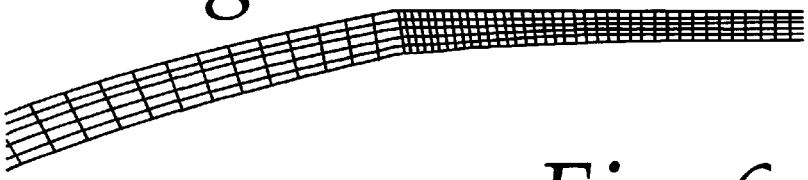
FIG. 5 illustrates the effect of flowrate variation shown as mesh of applicator channel exit.
Figure 6:
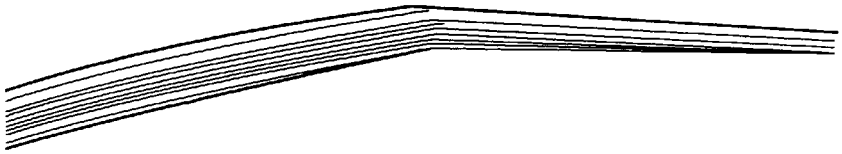
FIG. 6 illustrates the effect of flowrate variation shown as streamlines in applicator channel exit.
Figure 7:
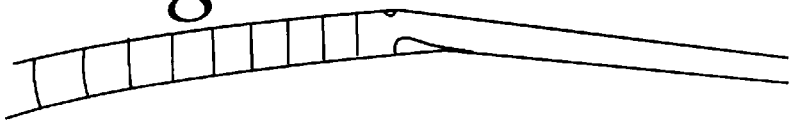
FIG. 7 illustrates the effect of flowrate variation shown as pressure contours in applicator channel exit.

The resulting coater configurations and streamlines are shown in FIGS. 3 and 4 for the cases listed in Table 4. A noticeable change in the free surface location is apparent as the flowrate is varied. An increase in flowrate results in a larger vertical cross-section under the web, a decrease in exit cross-section width on $G_5$, and an increase in the exit velocity magnitude on the same boundary.

The desire to avoid recirculating flow and minimize surface defects leads us to examine closely three regions where flow separation and recirculation is possible; the meniscus just aft of the applicator channel, the corner where the blade and web converge to construct the gap, and the blade tip where a meniscus forms and the substrate is coated. The mesh, streamlines, and pressure contours are plotted for these three regions in FIGS. 5–14. As demonstrated in these figures, the results show no flow separation or flow recirculation. A true vortex-free coating flow system exists at low flow rates (4 1/s/m) and high coating speeds (20 m/s).

Figure 15:
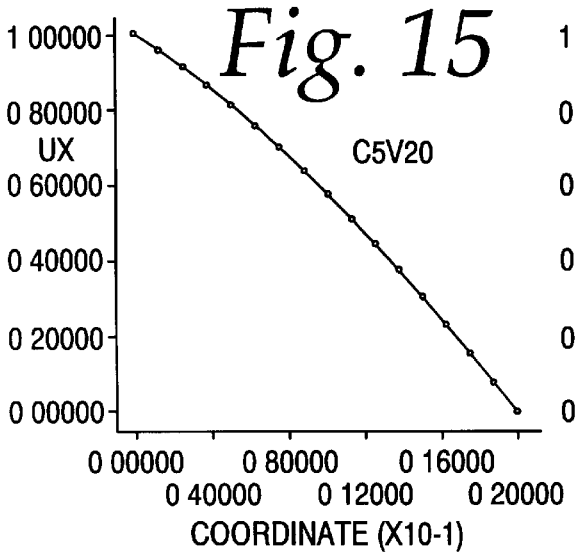
FIG. 15 illustrates the effect of flowrate variation shown as horizontal velocity profile at midpoint of blade tip.
Figure 16:
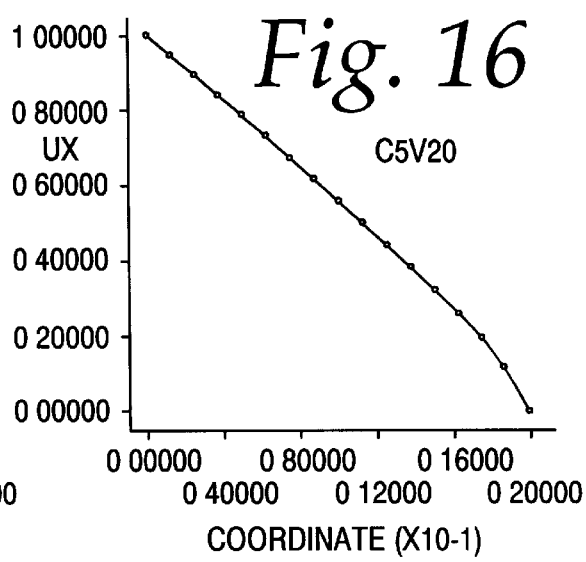
FIG. 16 illustrates the effect of flowrate variation shown as horizontal velocity profile at endpoint of blade tip.
Figure 17:
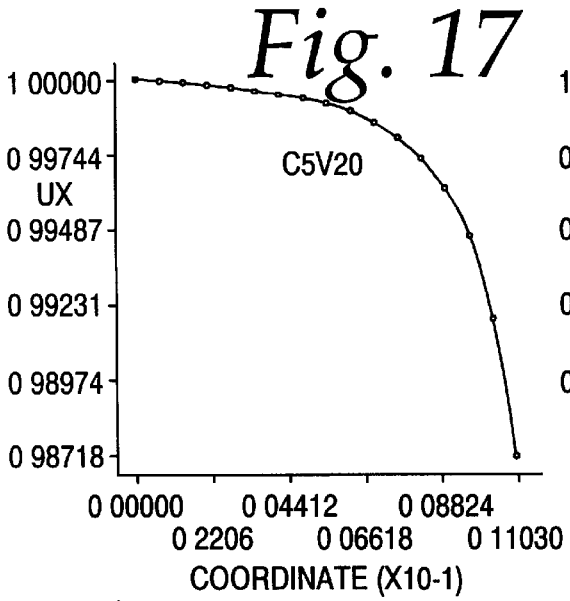
FIG. 17 illustrates the effect of flowrate variation shown as horizontal velocity profile at $\Gamma_6$.
Figure 20:
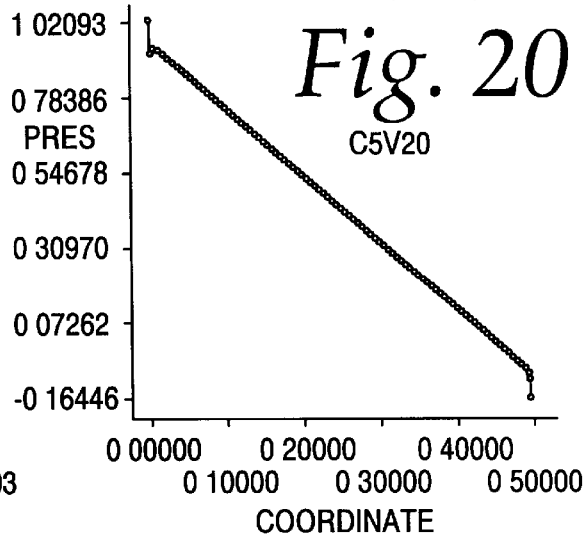
FIG. 20 illustrates the effect of flowrate variation shown as pressure distribution along the blade tip.
Figure 21:
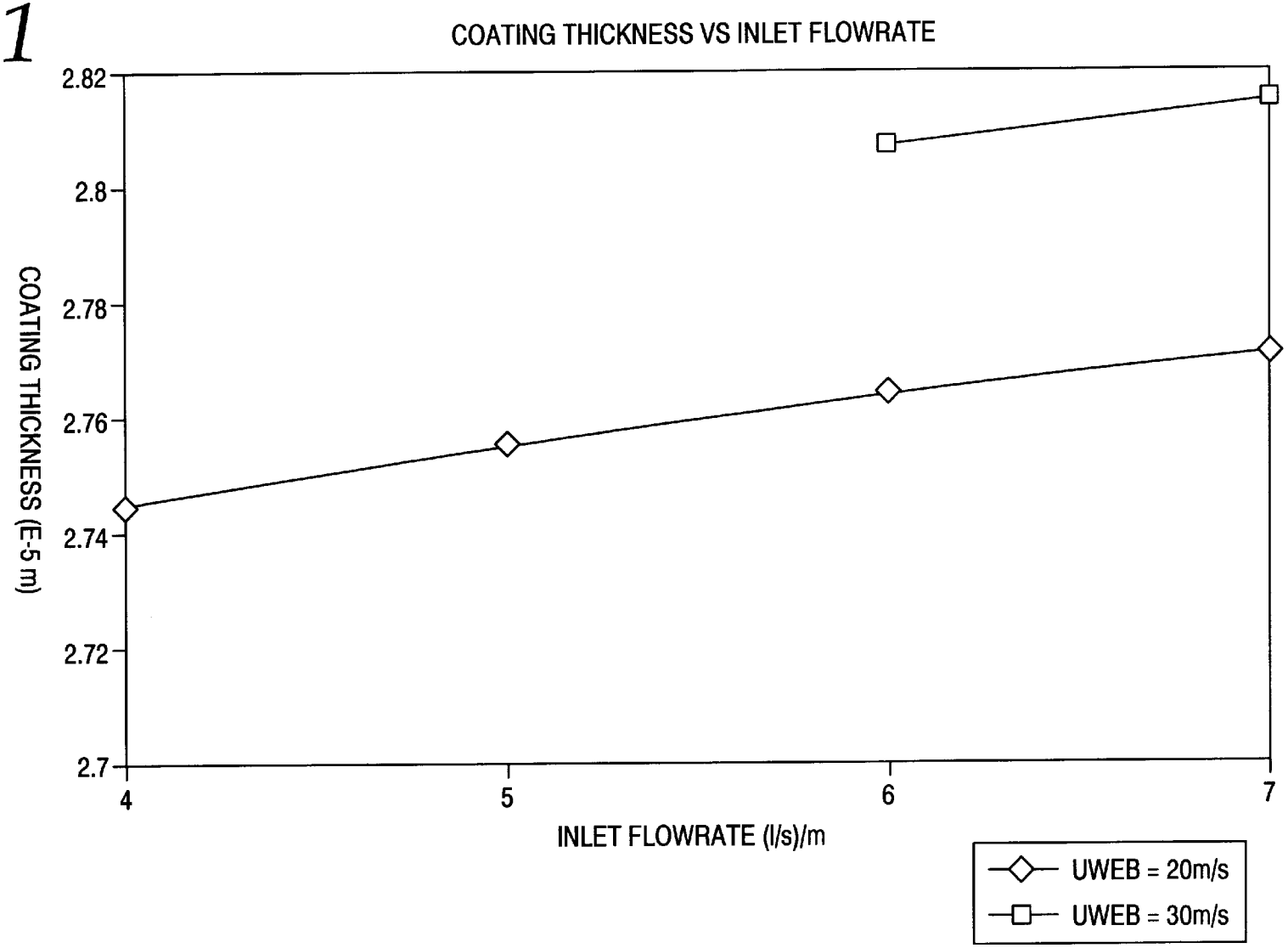
FIG. 21 illustrates the effect of flowrate variation shown as coating thickness vs inlet flowrate.
Figure 22:
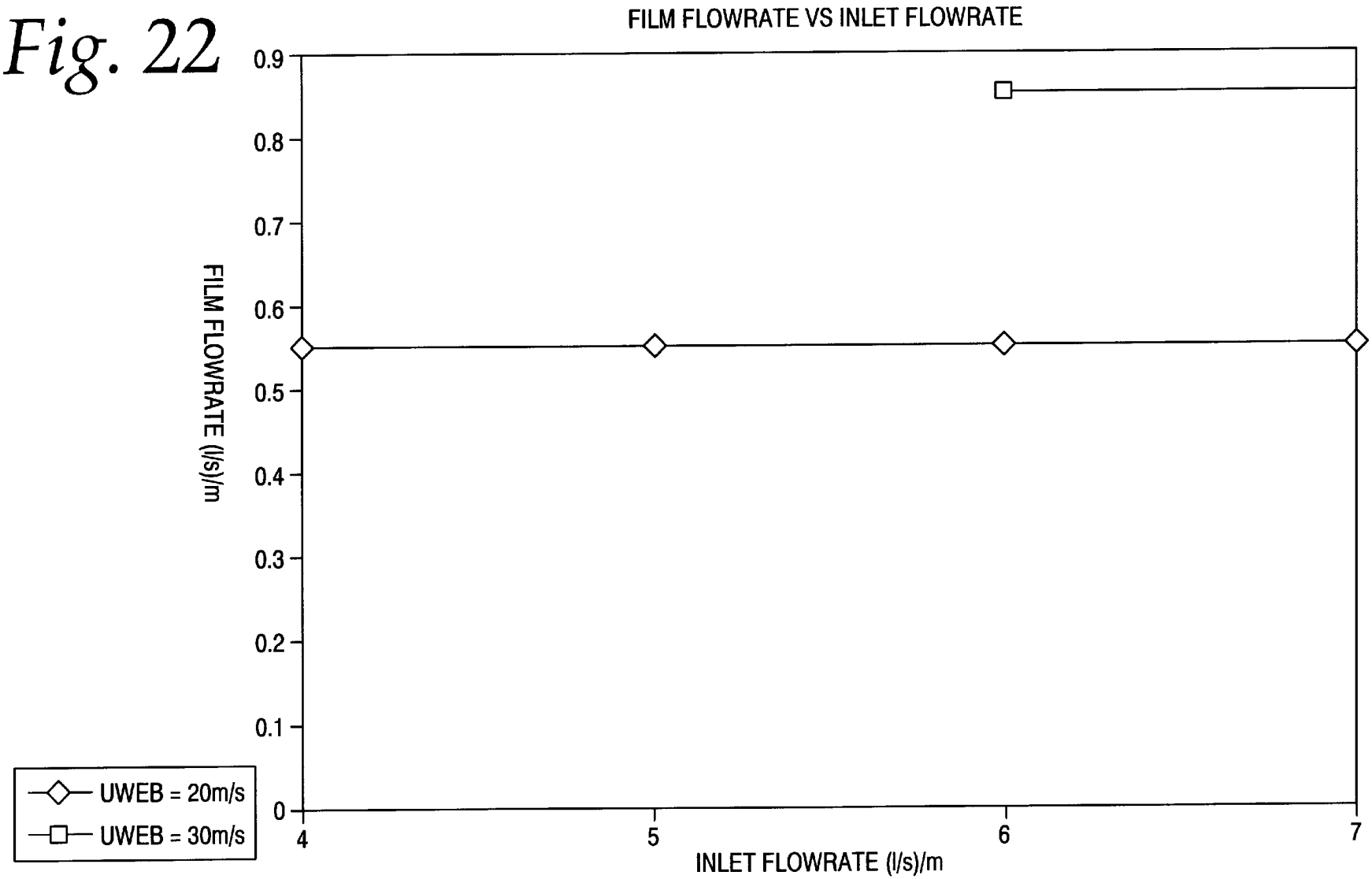
FIG. 22 illustrates the effect of flowrate variation shown as film flowrate vs inlet flowrate.
Figure 23:
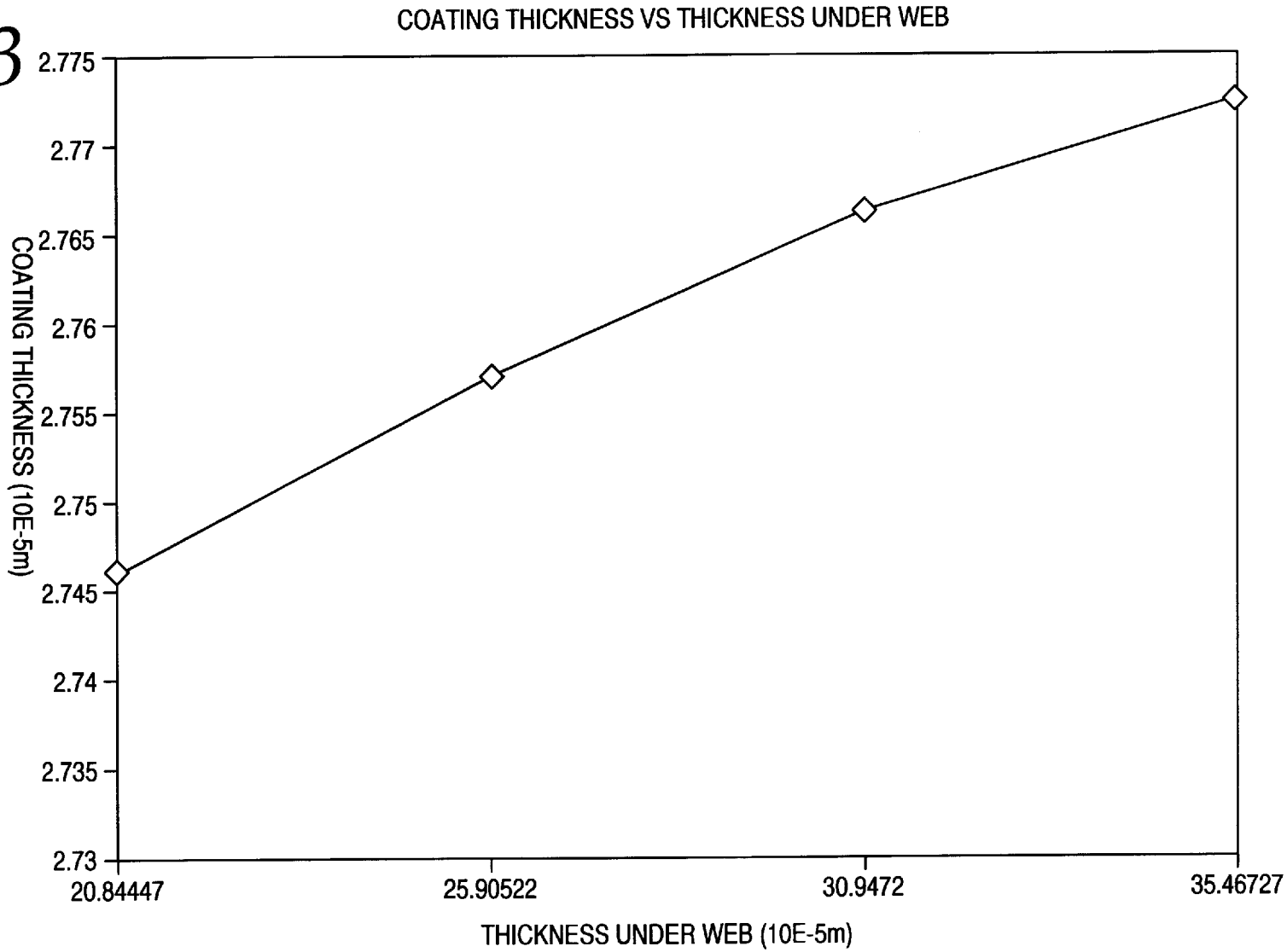
FIG. 23 illustrates the effect of flowrate variation shown as coating thickness vs thickness under web.

The velocity profiles in the gap region provide insight into the coating quality. FIG. 15 shows the horizontal, non-dimensional velocity profile at a location A—A on the blade tip while FIG. 16 depicts the profile at location B—B, the endpoint of the blade tip. FIG. 17 illustrates the effect of flowrate variation shown as horizontal velocity profile at $\Gamma_6$, the gap exit. At the static contact line it is clear that the formation of the meniscus slightly affects the velocity profile. The apparently linear pressure distribution along the blade tip, FIG. 20, indicates an almost constant pressure gradient in the gap that increases with the flowrate. These velocity profiles and pressure distribution demonstrate a nearly Poiseuille-Couette velocity distribution, the linear combination of flow between two walls at a relative velocity to one another and flow between stationary walls with a constant pressure gradient. Thus, the coating flowrate and thickness increase slightly with the increase in the inlet flowrate due to the larger pressure gradient, see FIGS. 21, 22 and 23. The portion of the coater where the blade and web form a converging channel is much more affected by the flowrate variation.

Figure 8:
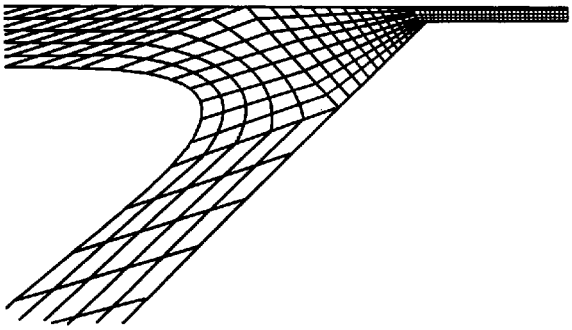
FIG. 8 illustrates the effect of flowrate variation shown as mesh of gap region.
Figure 9:
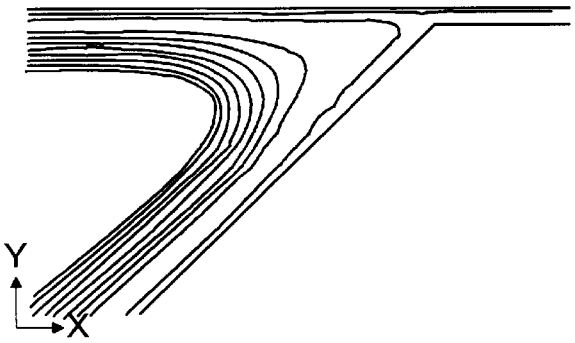
FIG. 9 illustrates the effect of flowrate variation shown as streamlines in gap region.
Figure 10:
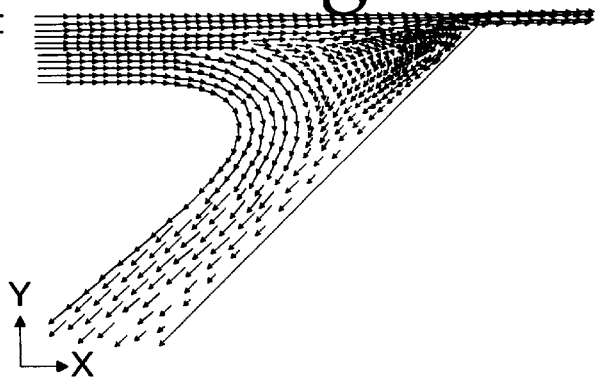
FIG. 10 illustrates the effect of flowrate variation shown as velocity field in gap region.
Figure 11:
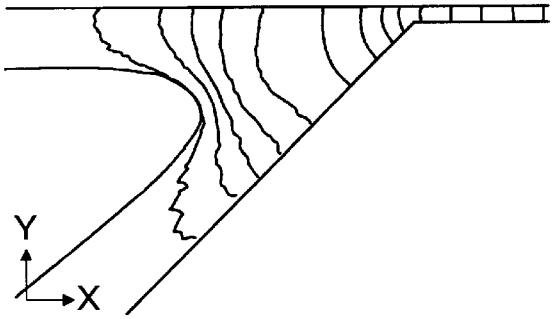
FIG. 11 illustrates the effect of flowrate variation shown as pressure contours in gap region.
Figure 12:
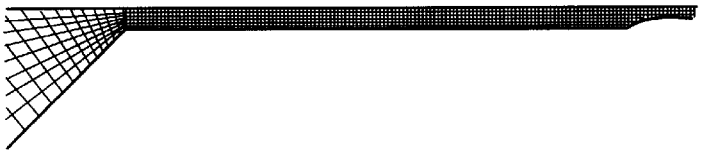
FIG. 12 illustrates the effect of flowrate variation shown as mesh of blade tip region.
Figure 13:
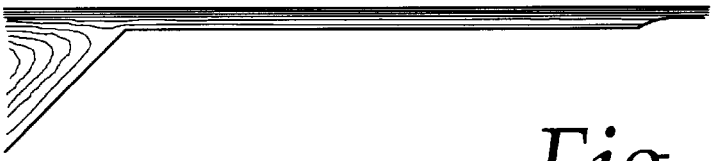
FIG. 13 illustrates the effect of flowrate variation shown as streamlines in blade tip region.
Figure 14:
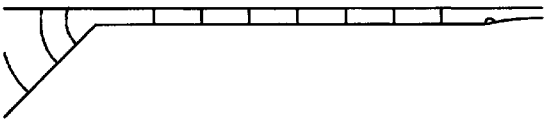
FIG. 14 illustrates the effect of flowrate variation shown as pressure contours in blade tip region.

Examination of the corner region formed by web and blade, presented in FIG. 8, shows significant free surface shape variation with flowrate variation. As the flowrate is decreased the free surface migrates toward the gap threatening to entirely disappear into the gap with further reduction of the inlet flowrate. The corresponding streamlines are shown in FIG. 9.

Figure 18:
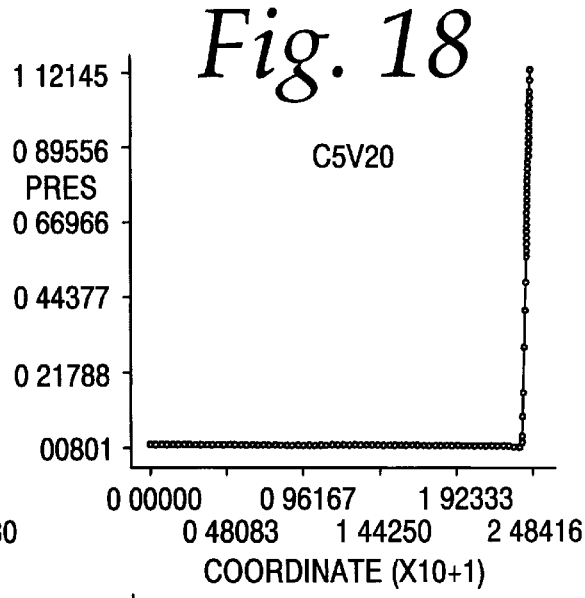
FIG. 18 illustrates the effect of flowrate variation shown as pressure distribution along the blade.
Figure 19:
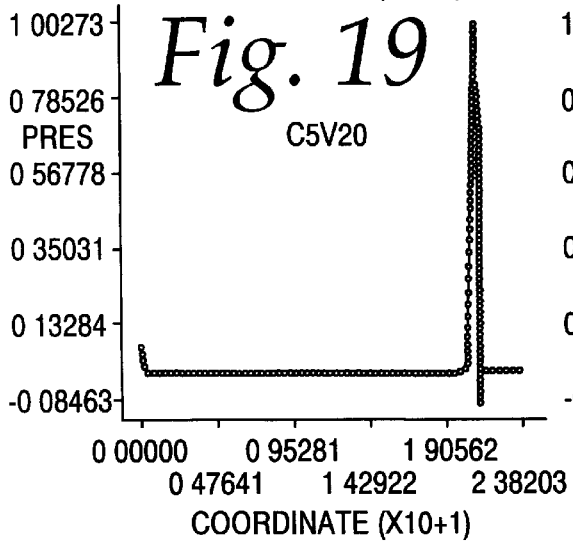
FIG. 19 illustrates the effect of flowrate variation shown as pressure distribution along the substrate.

The pressure along the blade and substrate are shown in FIGS. 18 and 19, all graphed quantities are non-dimensionalized. Table 6 can be used to convert all variables to dimensional quantities. Away from the gap the pressure remains fairly constant. Within the gap region the pressure peaks at the leading edge of the blade, just upstream of the gap. The maximum pressure increases as flowrate increases. At higher flowrates, the pressure increases in a more gradual manner, exhibiting a more distinct plateau. Following the peak, the flow field experiences sub-ambient pressures and then adjusts to the ambient exit pressure. The pressure contours in the gap region, shown in FIG. 11, indicate that a decrease in flowrate causes a larger pressure gradient but decreases the value of the maximum pressure.

TABLE 5

Case Study - Effect of Web Speed Variation

| Case | $U_{web}$ m/s | $U_P$ m/s | $q_{inlet}$ l/s/m | $q_{film}$ l/s/m | $C_i$ $\mu$m | Re | Ca | We l/ReCa |
|---|---|---|---|---|---|---|---|---|
| C6V15 | 15 | 3.6 | 6 | 0.409921 | 27.42438 | 45 | 300 | 1/13500 |
| C6V20 | 20 | 3.6 | 6 | 0.552128 | 27.66575 | 60 | 400 | 1/24000 |
| C6V25 | 25 | 3.6 | 6 | 0.695813 | 27.873 | 75 | 500 | 1/37500 |
| C6V30 | 30 | 3.6 | 6 | 0.841083 | 28.0655 | 90 | 600 | 1/54000 |
| C7V15 | 15 | 4.2 | 7 | 0.410793 | 27.48275 | 45 | 300 | 1/13500 |
| C7V20 | 20 | 4.2 | 7 | 0.553462 | 27.7325 | 60 | 400 | 1/24000 |
| C7V25 | 25 | 4.2 | 7 | 0.698024 | 27.9615 | 75 | 500 | 1/37500 |
| C7V30 | 30 | 4.2 | 7 | 0.844202 | 28.1695 | 90 | 600 | 1/54000 |

TABLE 4

Case Study - Effect of Flowrate Variation

| Case | $U_{web}$ m/s | $U_{inlet}$ m/s | $q_{inlet}$ l/s/m | $q_{film}$ l/s/m | $q_{exit}$ l/s/m | $C_i$ $\mu$m | $W_i$ $\mu$m | Re | Ca | We l/ReCa |
|---|---|---|---|---|---|---|---|---|---|---|
| C4V20 | 20 | 2.4 | 4 | .5481175 | 3.61508 | 27.465 | 208.4447 | 60 | 400 | 1/24000 |
| C5V20 | 20 | 3 | 5 | .550354 | 4.611883 | 27.575 | 259.0522 | 60 | 400 | 1/24000 |
| C6V20 | 20 | 3.6 | 6 | .552128 | 5.60895 | 27.66575 | 309.472 | 60 | 400 | 1/24000 |
| C7V20 | 20 | 4.2 | 7 | .553462 | 6.52 | 27.7325 | 354.6727 | 60 | 400 | 1/24000 |

TABLE 6

Conversion to Dimensional Units

| dimensionlessquantity | scale | web speed | multiply by | dimensional units |
|---|---|---|---|---|
| $p^*$ | $\rho U_s^2 = \rho U^2_{web}$ | 15 m/s | 0.270 E + 6 | Pa |
| $p^*$ | $\rho U_s^2 = \rho U^2_{web}$ | 20 m/s | 0.480 E + 6 | Pa |
| $p^*$ | $\rho U_s^2 = \rho U^2_{web}$ | 25 m/s | 0.750 E + 6 | Pa |
| $p^*$ | $\rho U_s^2 = \rho U^2_{web}$ | 30 m/s | 1.080 E + 6 | Pa |
| $q^*$ | $U_s L_s = U_{web} L_{inlet}$ | 15 m/s | 37.5 | l/s/m |
| $q^*$ | $U_s L_s = U_{web} L_{inlet}$ | 20 m/s | 50.0 | l/s/m |
| $q^*$ | $U_s L_s = U_{web} L_{inlet}$ | 25 m/s | 62.5 | l/s/m |
| $q^*$ | $U_s L_s = U_{web} L_{inlet}$ | 30 m/s | 75.0 | l/s/m |
| $u_i^*$ | $U_s = U_{web}$ | 15 m/s | 15 | m/s |
| $u_i^*$ | $U_s = U_{web}$ | 20 m/s | 20 | m/s |
| $u_i^*$ | $U_s = U_{web}$ | 25 m/s | 25 | m/s |
| $u_i^*$ | $U_s = U_{web}$ | 30 m/s | 30 | m/s |
| $x_i^*$ | $L_s = L_{inlet}$ | all | 0.0025 | m |

Table 5 gives results for the variation of the web speed for two flowrates; 6 and 7 1/s/m. The increase in web speed is effectively an increase in the two non-dimensional parameters characterizing the flow, the Reynolds Number and the Capillary Number. Here we find that as the inertial effects are magnified, the pressure gradient increases while the maximum pressure decreases. Along the web, a gradual pressure adjustment followed by a sharp pressure peak is observed at lower Reynolds Numbers. The effects of increase in web speed appear to have a qualitative relation to the effects of decreasing the flowrate.

Figure 24:
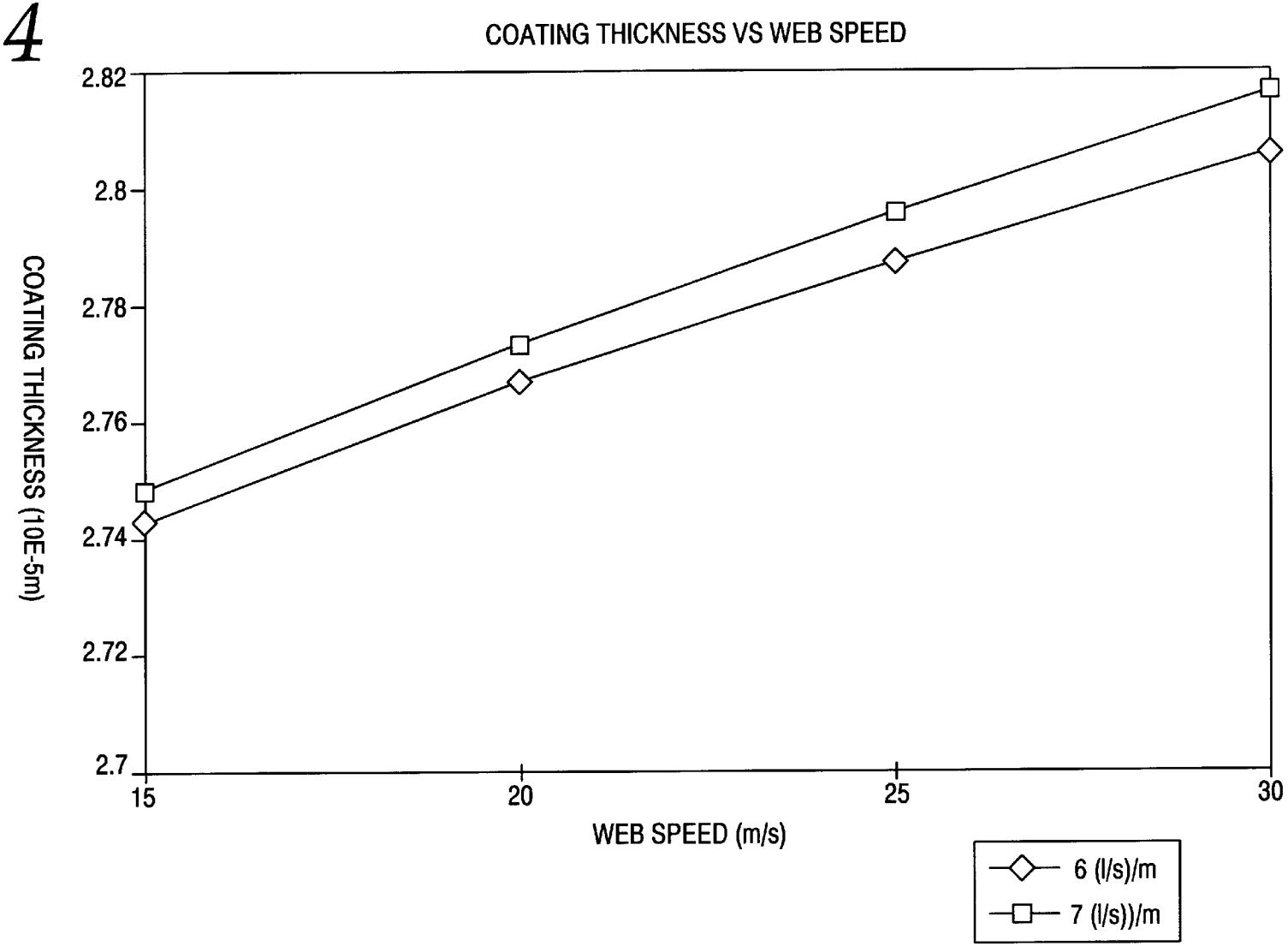
FIG. 24 illustrates the web speed variation shown as coating thickness vs web speed.
Figure 25:
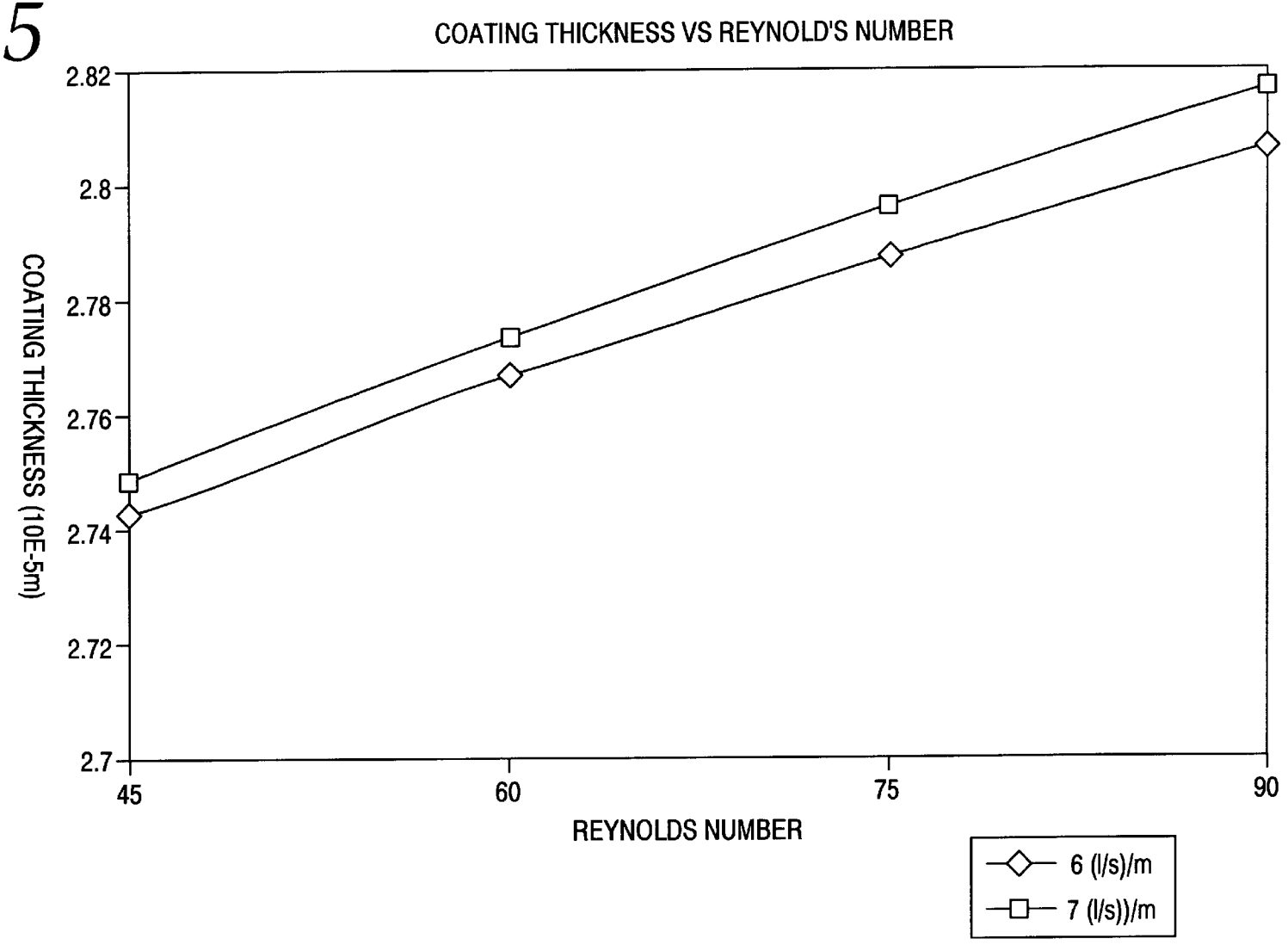
FIG. 25 illustrates the web speed variation shown as coating thickness vs reynolds number.
Figure 26:
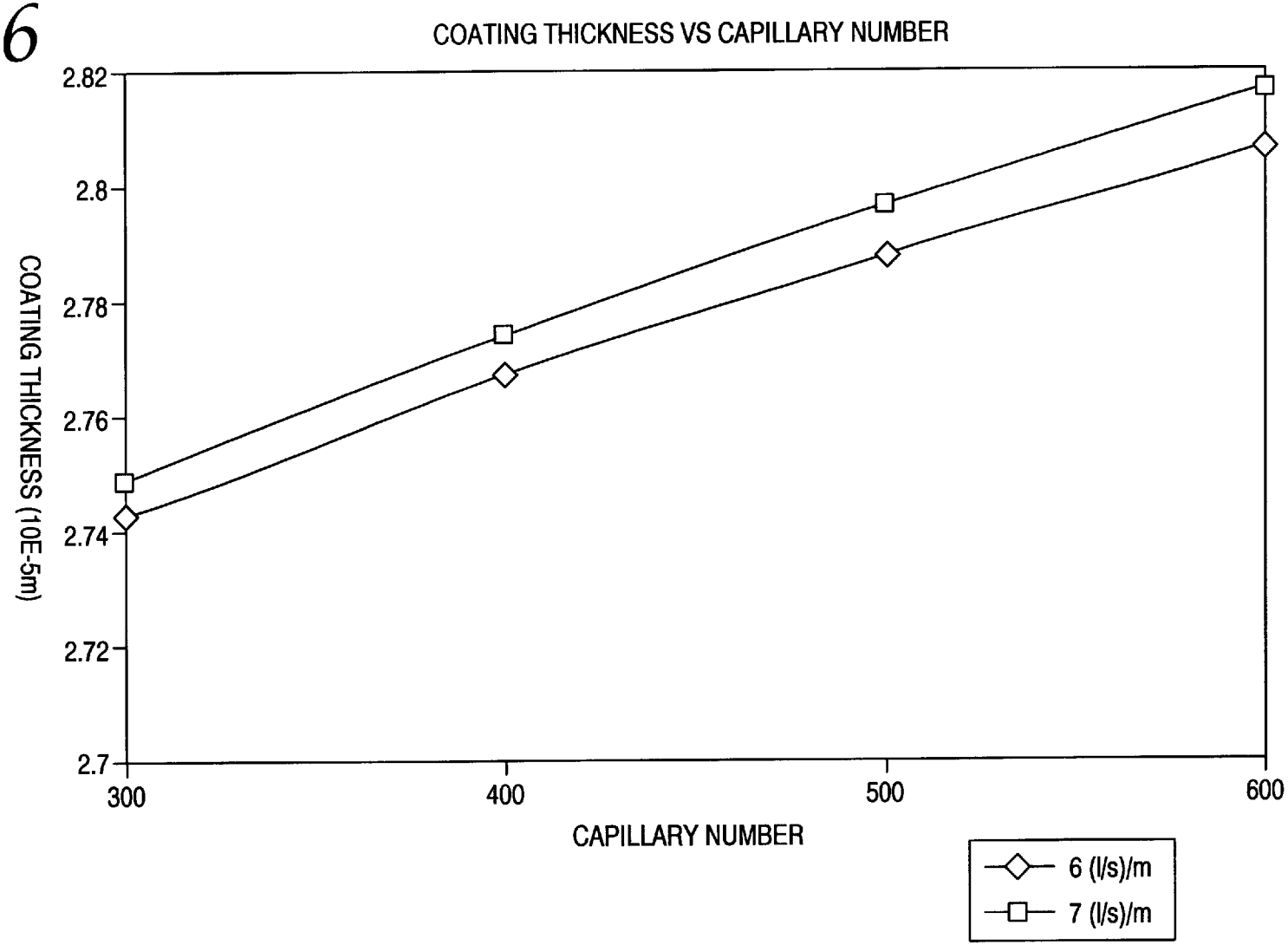
FIG. 26 illustrates the web speed variation shown as coating thickness vs capillary number.

A nearly Poiseuille-Couette velocity profile is again present in the gap region. Increasing web speed forces a greater amount of fluid to exit the gap through viscous shear and the nearly constant pressure gradient. Coating thickness increase is observed with an increase of web speed, as shown in FIGS. 24, 25 and 26.

The results of the present analysis exhibit qualitative agreement with those of Pranckh & Scriven (1988), as discussed above in connection with the background of the invention. The graphical flow solution in the present study, FIGS. 8–14, should be compared to those of Pranckh & Scriven for the velocity field, streamlines, and pressure contours of their base case. Pranckh & Scriven looked at the pressure distribution along the substrate for their base case and another case where both the Reynolds Number and flowrate were increased. In their base case Pranckh & Scriven found the pressure distribution had an inflection point, or plateau, followed by a peak just prior to the leading edge of the blade. Pranckh & Scriven found increasing the Reynolds Number and flowrate decreased the maximum pressure and eliminated the pressure plateau.

In the described embodiments it is determined that the pressure profile along the substrate has a peak just prior to the gap. The slope of the pressure plateau and the dimensionless pressure peak were also found to decrease with increasing Reynolds Number. The described embodiments also investigate the effects of the variation of the web speed (or $Re|_{q=const}$ and $Ca|_{q=const}$) and flowrate ($q|_{Uweb=const}$) on the coating thickness, see FIGS. 24, 25 and 26. Similar to Pranckh & Scriven, it is found that the coating thickness varies nearly linearly with the increase in Reynolds Number, Capillary Number, and flowrate.

While preferred embodiments of the invention has been shown and described for the apparatus and method for coating devices for traveling webs in which a flowing stream of liquid coating composition flows in the same direction as the web movement in a vortex-free coater reducing wall shear stress on the coating material, other embodiments of the present invention will be readily apparent to those skilled in the art from consideration of the specification and practice of the invention disclosed herein. It is intended that the specification and examples be considered as exemplary only, with a true scope and spirit of the invention being indicated by the claims.

Appendix:

Nomenclature $\delta_{ij}$ Kronecker delta
$\epsilon_{ij}$ rate of strain tensor
$\gamma$ surface tension
$\Gamma_i$ boundary
$\eta$ height of free surface
$\mu$ dynamic viscosity
$\mu_o$ zero shear rate viscosity
$\mu_\infty$ infinite shear rate viscosity
$\rho$ density
$\sigma_{ij}$ stress tensor
$\sigma_n$ normal component of the traction vector
$\sigma_t$ tangential component of the traction vector
$\tau_{ij}$ deviatoric stress tensor
Ca Capillary Number
$C_t$ coating thickness
c Carreau exponent
$f_i$ component of gravitational acceleration
H Gaussian mean curvature of the free surface
K time constant
$L_{ace}$ applicator channel exit
$L_{blade}$ blade length (modeled)
$L_{gap}$ gap length
$L_{inlet}$ inlet length
$L_s$ length scale
$L_{thick}$ blade thickness
$L_{web}$ web length (modeled)
1/s/m (liter/sec)/meter
m/s meter/sec
$n_i$ unit normal vector
p pressure
$p_a$ ambient pressure
$q_{exit}$ flowrate exiting along blade
$q_{film}$ flowrate exiting gap
$q_{inlet}$ inlet flowrate
Re Reynolds Number
S singularity
t time
$\hat{t}_i$ unit tangent vector
$U_{inlet}$ centerline velocity on inlet Poiseuille profile
$U_s$ length scale
$U_{web}$ web velocity
$u_i$ velocity
We Weber Number
$W_t$ vertical distance from web to free surface at C—C
$x_i$ Cartesian coordinate
$<_{blade}$ angle of blade
* superscript denotes dimensionless variable

What is claimed is:

1. A coating device for applying a liquid coating composition on a web of material as the web travels along a web path through the device from an upstream direction to a downstream direction, the device comprising:

a doctor element spaced from the web for spreading and defining the thickness of the liquid coating composition on the web, the doctor element extending across the web path;

a coating composition application chamber adapted for receiving a liquid flow of the liquid coating composition from the upstream direction to the downstream direction, the application chamber extending across the web path, the application chamber having upstream and downstream sides with the web adapted to travel along the web path from the upstream side to the downstream side of the application chamber, the coating application chamber comprising in cross-section, an upstream interior side wall, an upstream boundary wall and the doctor element, the coating composition application chamber further comprising a first channel for receiving a flow of the liquid coating composition at the upstream interior side wall, and a gas channel for receiving a flow of a carrier gas as a gas layer introduced through said gas channel which terminates adjacent said first channel at the upstream side of the application chamber, the gas from the gas channel interfacing the coating composition, the flow of the liquid coating composition and the flow carrier gas traveling in the direction of the travel of the web, the flow of the carrier gas in direct contact with the coating composition and supporting the liquid flow of the liquid coating composition between the gas layer and the web, the gas layer opposite the web defining a top interior gas layer wall and the gas layer opposite the doctor blade defining a downstream interior gas layer wall, the upstream boundary wall and the upstream interior wall being substantially parallel to the other and each having a terminating curvilinear section which are substantially parallel to the other, the upstream boundary wall adapted to terminate in tangential relation with the web path, the top interior gas layer wall substantially conveying the liquid coating composition from the terminating curvilinear section of the upstream interior wall in the direction of the travel of the web to the downstream interior gas layer wall and doctor element, the upstream walls, the top interior gas layer wall and web, the downstream interior gas layer wall and doctor element define a path in which a flowing stream of the liquid coating composition flows downstream in the direction of travel of the web, the flow of carrier gas reducing wall shear stress on the flowing stream of the liquid coating composition and reducing the formation of recirculating eddies and vortices in the coating composition as the coating composition flows downstream through the coating application chamber.

2. A coating device in accordance with claim 1 wherein the carrier gas comprises air pumped into the coating application chamber maintaining the liquid coating composition in contact with the web under pressure at least at the upstream side of the application chamber preventing air entrainment as the coating composition is introduced to the web.

3. A coating device in accordance with claim 2 wherein the coating application chamber comprises a top interior wall opposite and substantially parallel to the web and the top interior gas layer wall, and a downstream interior wall opposite and substantially parallel to the doctor element and the downstream interior gas layer wall defining the coating application chamber as a closed system for the downstream flow of the liquid coating composition.

4. A coating device in accordance with claim 3 wherein the upstream boundary wall and the upstream interior side wall are upwardly inclined in a direction toward the downstream side.

5. A coating device in accordance with claim 3 wherein the downstream interior wall and the doctor element are downwardly inclined in a direction toward or away from the upstream side.

6. A coating device for applying a liquid coating composition on a web of material as the web travels along a web path through the device from an upstream direction to a downstream direction, the device comprising:

a doctor element spaced from the web extending across the web path for spreading and defining the thickness of the liquid coating composition on the web;

a coating composition application chamber adapted for receiving a liquid flow of the liquid coating composition from the upstream direction to the downstream direction, the application chamber extending across the web path, the application chamber having upstream and downstream sides with the web adapted to travel along the web path from the upstream side to the downstream side of the application chamber, the coating application chamber comprising in cross-section, an upstream interior side wall and an upstream boundary wall for directing the liquid coating composition flow into the application chamber, and the doctor element at the downstream side of the application chamber, the coating composition application chamber further comprising a first channel for receiving a flow of the liquid coating composition at the upstream interior side wall, and a gas channel which terminates adjacent the first channel, the gas channel for transmitting a flow of a pressurized carrier gas to pressurize said application chamber, said carrier gas interfacing in direct contact with the flow of liquid coating composition and supporting said composition as the web and the liquid coating composition travel in the same direction from the upstream side of the application chamber to the doctor element the pressurized carrier gas reducing vortices and shear stress on the liquid coating composition in the application chamber as the coating composition flows downstream to the doctor blade.

7. A coating device in accordance with claim 6 wherein the upstream boundary wall and the upstream interior wall are substantially parallel to the other, each having a terminating curvilinear section which are substantially parallel to the other, the upstream boundary wall adapted to terminate in tangential relation with the path web, reducing the formation of recirculating eddies and vortices in the coating composition.

8. A coating device for applying a liquid coating composition on a web of material as the web travels along a web path through the device from an upstream direction to a downstream direction, the device comprising:

a doctor element spaced from the web for spreading and defining the thickness of the liquid coating composition on the web, the doctor element extending across the web path;

a coating composition application chamber extending across the web path, the application chamber having upstream and downstream sides with the web adapted to travel from the upstream side to the downstream side of the application chamber, the application chamber comprising in cross-section, an upstream interior side wall, an upstream boundary wall and the doctor element;

a coating composition channel for transmitting a flow of the liquid coating composition on the web at the upstream side of the application chamber;

a carrier gas channel for transmitting a flow of a carrier gas through the application chamber from the upstream side of the application chamber to the downstream side of the application channel, said coating composition channel and carrier gas channel terminating adjacent each other for positioning the liquid coating composition between the carrier gas and the web, the carrier gas from said carrier gas channel in direct contact with the coating composition and substantially directing the liquid coating composition from said coating composition channel toward the web in a path in which the the liquid coating composition flows downstream in the direction of travel of the web; and said carrier gas channel transmitting the carrier gas through the application chamber to maintain contact with the liquid coating composition in contact with the web to prevent air entrainment from outside said application chamber into the coating composition and to reduce the formation of recirculating eddies and vortices in the coating composition.

9. A coating device in accordance with claim 8 wherein the carrier gas comprises air pumped into said coating application chamber through said second upstream interior channel.

10. A coating device in accordance with claim 9 wherein said air carrier gas maintains the liquid coating composition in contact with the web under pressure at least at the upstream side of the application chamber.

11. A coating device in accordance with claim 8 comprising at least one downstream opening adjacent said doctor element of said application chamber for receiving the coating composition and the carrier gas flowing downstream in said application chamber.

12. A coating device in accordance with claim 11 wherein said carrier gas maintaining the liquid coating composition in contact with the web under pressure at least at the upstream side of the application chamber provides a reduced application chamber pressure downstream toward said at least one downstream opening.

13. A coating device in accordance with claim 8 wherein the flow of the liquid coating composition and the flow of the carrier gas are introduced from said first and second channels at approximately the same flow rates from the upstream side of said application chamber in the direction of travel of the web to reduce shear stress on the flowing stream of the liquid coating composition in the application chamber as the coating composition flows downstream.

14. A coating device in accordance with claim 8 wherein the upstream boundary wall and the upstream interior side wall are upwardly inclined in a direction toward the downstream side.

15. A coating device in accordance with claim 8 wherein the downstream interior wall and the doctor element are downwardly inclined in a direction toward or away from the upstream side.

* * * * *

UNITED STATES PATENT AND TRADEMARK OFFICE

CERTIFICATE OF CORRECTION

PATENT NO. : 5,820,674

DATED : October 13, 1998

INVENTOR(S) : Cyrus K. Aidun

It is certified that error appears in the above-indentified patent and that said Letters Patent is hereby corrected as shown below:

Column 1, line 5, insert the following paragraph:

--This invention was made with Government support under National Science Foundation Grant Number CTS-9258667 awarded by the National Science Foundation. The Government has certain rights in this invention.--

Signed and Sealed this

Tenth Day of August, 1999

*Attest:*

*Attesting Officer*

Q. TODD DICKINSON

*Acting Commissioner of Patents and Trademarks*